US006533619B2

(12) United States Patent
Wakata et al.

(10) Patent No.: US 6,533,619 B2
(45) Date of Patent: Mar. 18, 2003

(54) CONSTRUCTION AND A TERMINAL CAP FOR PREVENTING AN ERRONEOUS CONNECTION

(75) Inventors: Shigekazu Wakata, Yokkaichi (JP); Keiichi Itou, Toyota (JP); Kazuyuki Shiraki, Toyota (JP); Masanori Wakui, Toyota (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/803,069

(22) Filed: Mar. 9, 2001

(65) Prior Publication Data

US 2001/0024909 A1 Sep. 27, 2001

(30) Foreign Application Priority Data

Mar. 9, 2000 (JP) ..... 2000-064944

(51) Int. Cl.[7] ..... H01R 13/64

(52) U.S. Cl. ..... 439/680; 439/202; 439/501; 439/521; 439/754

(58) Field of Search ..... 439/680, 521, 439/202, 501, 502, 503, 504, 505, 754

(56) References Cited

U.S. PATENT DOCUMENTS 5,295,860 A * 3/1994 Jozefczyk et al. ..... 439/503
5,399,103 A * 3/1995 Kuboshima et al. ..... 439/509
5,413,500 A * 5/1995 Tanaka ..... 439/521
5,439,759 A * 8/1995 Lippert et al. ..... 439/65
5,791,936 A * 8/1998 Nicholson ..... 439/521
5,977,485 A * 11/1999 Yoshimura et al. ..... 174/138
6,203,383 B1 * 3/2001 Iby et al. ..... 439/773

FOREIGN PATENT DOCUMENTS

| | | |
|---|---|---|
| DE | 8520278 | 9/1985 |
| DE | 3736414 C1 | 11/1988 |
| FR | 2 688 945 | 9/1993 |

* cited by examiner

*Primary Examiner*—P. Austin Bradley
*Assistant Examiner*—Truc Nguyen

(57) ABSTRACT

A terminal cap (10) is provided to prevent erroneous use of a booster cable to connect batteries that have different specifications. The terminal cap (10) is mounted to cover a battery terminal (T) to be connected with one of electrodes of a 32V-battery. The terminal cap (10) has protection walls (20) that extend from a first accommodating portion (11*a*) for accommodating a connecting portion (7) of the battery terminal (T). The protection walls (20) are formed to be higher than a threaded shaft (1) of the electrode. Thus, even if an attempt is made to erroneously connect a booster cable, the protection walls (20) will interfere with the booster cable and prevent connection with the electrode located inside the protection walls (20).

5 Claims, 7 Drawing Sheets

CONSTRUCTION AND A TERMINAL CAP FOR PREVENTING AN ERRONEOUS CONNECTION

BACKGROUND OF THE INVENTION

1. Field of the Invention

The invention relates to a construction and to a terminal cap for preventing erroneous connection of two different types of batteries by a connection means, such as a booster cable.

2. Description of the Related Art

Twelve-volt batteries typically are used in automotive vehicles. In recent years, however, consideration has been given to automotive actuators that are electric. Under such circumstances, the voltage and capacity of currently used batteries could be insufficient. Thus, batteries that have a higher voltage than conventional batteries are being considered for use in automotive vehicles.

The use of higher voltage batteries would create the potential for a conventional low-voltage battery to be connected to a high-voltage battery by a booster cable when a battery dies.

In view of such a potential, an object of the present invention is to provide a construction and a terminal cap for preventing batteries that have different specifications from being connected erroneously e.g. by a booster cable.

SUMMARY OF THE INVENTION

The subject invention is directed to a construction for preventing erroneous connection of two different types of batteries, such as a high-voltage battery and a low-voltage battery mounted in automotive vehicles. The connection between the batteries may be made by a connection means, such as a booster cable. The construction for preventing erroneous connection may comprise at least one protecting portion near an electrode of either one of the batteries. The protecting portion near the electrode interferes with the clip at the end of the booster cable, or with other such connection means, to prevent connection with the electrode. Therefore, erroneous connection of batteries that have different specifications can be prevented.

A terminal cap may cover a battery terminal that is connectable with the electrode, and the protecting portion may be formed integrally or unitarily with the terminal cap. Accordingly, the protecting portion utilizes the existing terminal cap for covering the battery terminal and the electrode. Therefore, it is not necessary to add a special construction to prevent erroneous connection.

A first accommodating portion may be formed at the leading end of the terminal cap for accommodating a connecting portion of the battery terminal that is to be connected with the electrode. The protecting portion is formed such that an opening edge of the first accommodating portion is higher or projects a greater distance than the upper end of the electrode when the battery terminal that is covered by the terminal cap is connected with the electrode.

Accordingly, when the battery terminal covered by the terminal cap is connected with the electrode of the battery, the opening edge of the first accommodating portion of the terminal cap is higher than the upper end of the electrode. Thus, the upper or projecting edge of the first accommodating portion interferes with the clip of the booster cable and prevents connection of the clip with the electrode.

A plurality of battery terminals may be placed one over another on an electrode, and the terminal cap may be mounted to at least partly cover the uppermost battery terminal. Additionally, the opening edge of the first accommodating portion of the terminal cap preferably is higher or projects more than the upper or projecting end of the electrode. Accordingly, erroneous connection can be avoided if the terminal cap at least partly covers the uppermost battery terminal and the opening edge of the first accommodating portion is above both the electrode and the upper battery terminal.

The invention also is directed to a terminal cap for preventing erroneous connection of two different types of batteries, such as a high-voltage battery and a low-voltage battery mounted in automotive vehicles. The connection between the batteries may be by a connection means, such as a booster cable. The terminal cap comprises at least one integral or unitary protecting portion that is mountable to cover a battery terminal that can be connected with an electrode of one of the batteries. The protecting portion interferes with a clip at the end of the booster cable to prevent connection of the clip with the electrode.

According to a preferred embodiment, a first accommodating portion is formed at the leading end of the terminal cap for at least partly accommodating a connecting portion of the battery terminal to be connected with the electrode.

Preferably, the protecting portion is formed such that an opening edge of the first accommodating portion is higher or projects a greater distance than the upper end of the electrode when the battery terminal substantially covered by the terminal cap is connected with the electrode.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
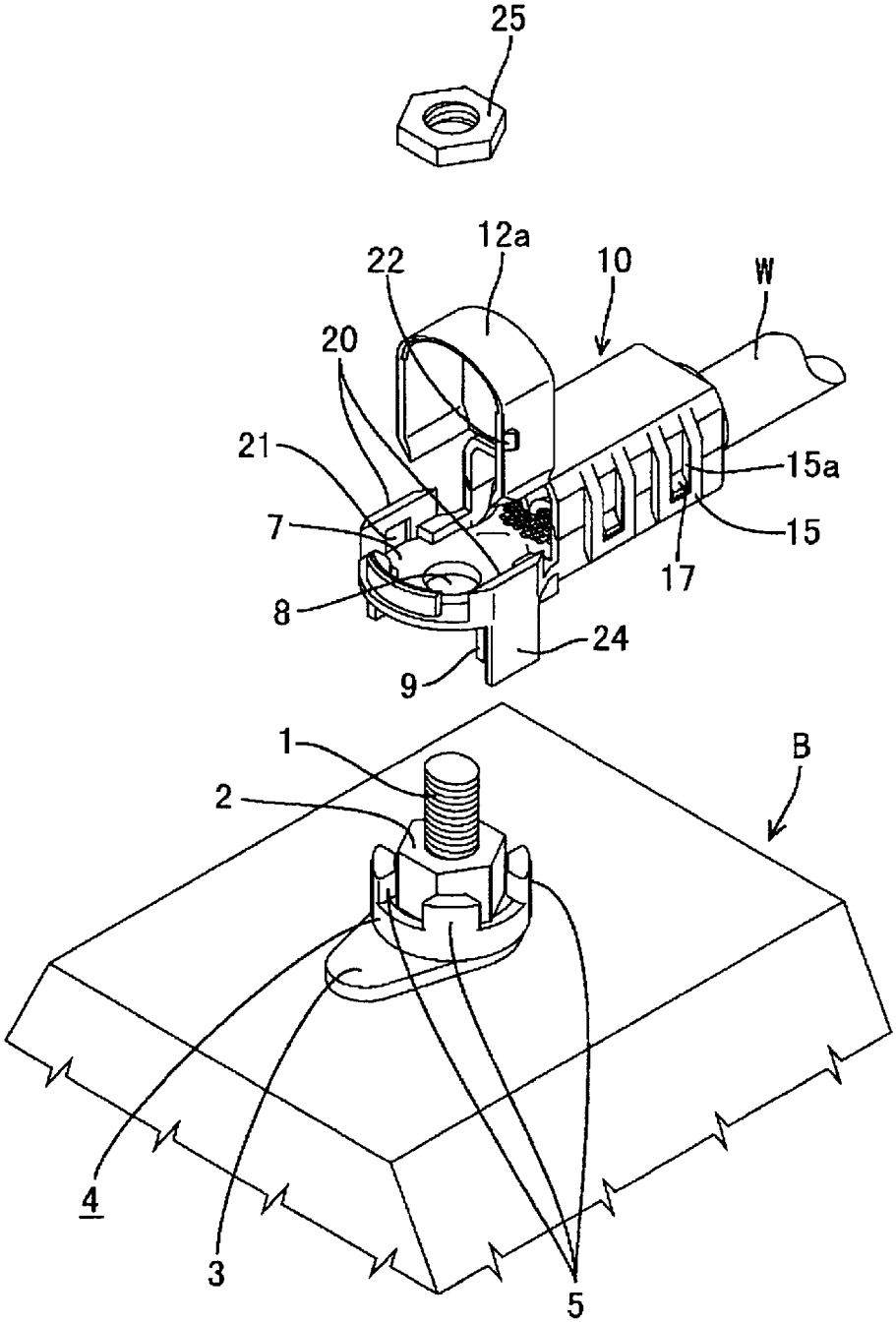
FIG. 1 is an exploded perspective view showing a state of an electrode of a battery and a battery terminal.

The letter B in FIGS. 1 TO 5 identifies a battery in accordance with the invention. The battery B in FIG. 1 is of a predetermined type, e.g. a 36V-battery, and can be mounted in an automotive vehicle. A threaded shaft 1 extends from an upper or first surface of the battery B and is a (+)-electrode. A first nut 2 can be screwed down on the threaded shaft 1, and a washer 3 and a rotation-preventing member 4 are fastened between the first nut 2 and the upper surface of the battery B. The rotation preventing member 4 is formed at its periphery with rotation preventing projections 5, which preferably are spaced apart circumferentially, e.g. at an interval of about 90°.

Figure 4:
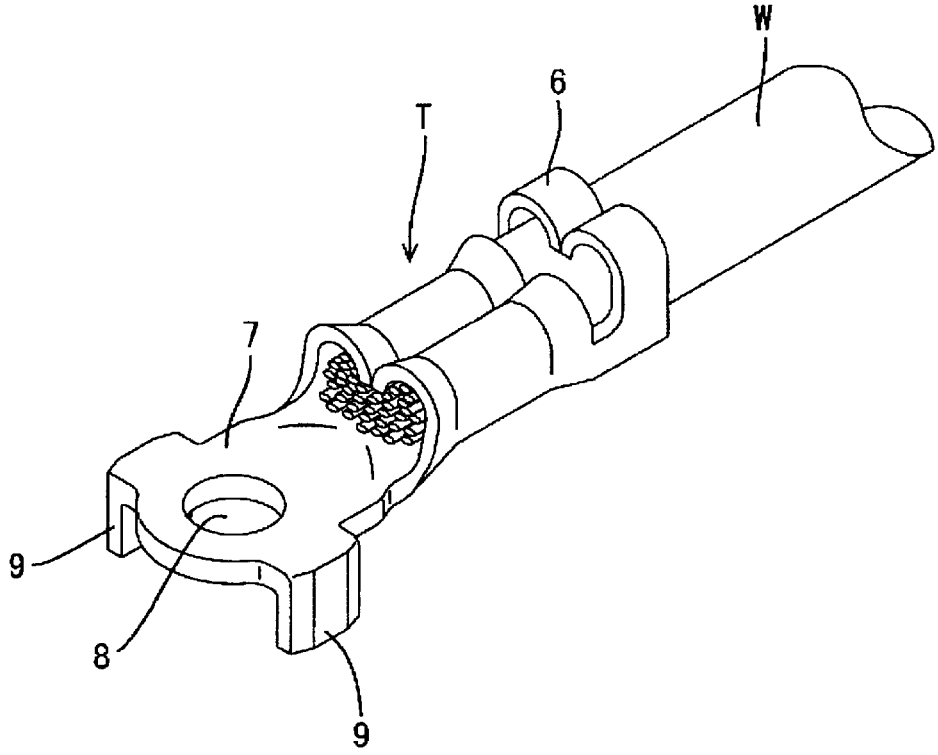
FIG. 4 is a perspective view of the battery terminal.

The threaded shaft 1 can be connected with a battery terminal T that is shown in FIG. 4. The battery terminal T is stamped from a conductive metal plate and has opposite front and rear ends. The rear end of the battery terminal T is configured for secure electrical and mechanical connection to a wire "w". More particularly, the wire "w" has a conductor and an insulating coating. The conductor of the wire "w" is exposed by stripping off a leading end of the insulating coating. The rear end of the battery terminal T defines a barrel 6 that is configured for crimped connection with the insulating coating of the wire "w". Portions of the battery terminal T forward of the barrel 6 are configured for crimped connection with the conductor of the wire "w". A connecting portion 7 is formed at the front of battery terminal T and is configured for connection with the threaded shaft 1. Specifically, a through hole 8 is formed in the center of the connecting portion 7 and is dimensioned to receive the threaded shaft 1. Two locking projections 9 are bent down at the outer periphery of the connecting portion 7.

A terminal cap 10 made is mounted on the battery terminal T that will be connected with the (+)-electrode. The terminal cap 10 preferably is formed from a synthetic resin and includes a fixed portion 11 for at least partly accommodating the battery terminal T. The terminal cap 10 also includes a cover 12 that is hinged unitarily or integrally to the fixed portion 11 to open and close. The fixed portion 11 comprises a first accommodating portion 11*a* for at least partly accommodating the connecting portion 7 of the battery terminal T and a second accommodating portion 11*b* for accommodating a section of the wire "w". The cover 12 comprises a first lid 12*a* that corresponds to the first accommodating portion 11*a* and a second lid 12*b* that corresponds to the second accommodating portion 11*b*.

The second lid 12*b* is pivotal to open and close about second hinges 14 on one longer side of the second accommodating portion 11*b*. Locking arms 15 project from an edge of the second lid 12*b* opposite from the second hinges 14. Each locking arm 15 has a locking hole or recess 15*a*. Three guides 16 extend from the other longer side of the second accommodating portion 11, as shown, and locking projections 17 extend from locations between the guides 16. The guides 16 guide the locking arms 15 toward the respective locking projections when the second lid 12*b* is closed. The second lid 12*b* can be held closed by engaging the locking projections 17 with the locking holes 15*a*.

The first accommodating portion 11*a* has a substantially semicircular outer configuration and a connection opening 18. The connection opening 18 enables the locking projections 9 of the battery terminal T to project down between the rotation preventing projections 5 of the rotation preventing member 4 when the connecting portion 7 of the battery terminal T is fit into the first accommodating portion 11*a*. In this way, rotation or relative movement of the terminal cap 10 and the battery terminal T with respect to the electrode can be prevented. An arcuate guiding projection 19 projects at the front end of the upper edge of the first accommodating portion 11*a* to guide the closing movement of the first lid 12*a*.

Upper protection walls 20 project from opposite sides of the first accommodating portion 11*a* and substantially face each other, and a locking recess 21 is formed in the inner surface of each upper protection wall 20. On the other hand, the first lid 12*a* is pivotal to open and close about a first hinge 13 at the front edge of the second lid 12*b*. The inner surface of the first lid 12*a* can be guided by the guiding projection 19 while the first lid 12*a* is being closed, and locking projections 22 on the outer surface of the first lid 12*a* engage the corresponding locking recesses 21 to hold the first lid 12*a* closed. Lower protection walls 24 extend down from the first accommodating portion 11*a*. The lower protection walls 24 are narrower than the upper protection walls 20 and preferably are substantially flush with the outer surfaces of the upper protection walls 20. The lower protection walls 24 extend down sufficiently for their bottom ends to be located lower than the bottom ends of the locking projections 9 when the battery terminal T is accommodated in the terminal cap 10. Thus, the lower protection walls 24 substantially abut the upper surface of the battery B when the battery terminal T is connected with the threaded shaft 1 together with the terminal cap 10. In this state, the upper or projecting end positions of the upper protection walls 20 are higher or project beyond the upper or projecting end of the threaded shaft 1. In other words, the protection walls 20 have a projecting length that is greater than the projecting length of the threaded shaft 1. Accordingly, the threaded shaft 1 cannot be reached by a clip or clamp C of the booster cable. Due to these relative dimensions and a specified spacing, the upper protection walls 20 interfere with a clip or clamp C mounted at the leading end of a booster cable, and prevent the clip C from connection with the threaded shaft 1 or with a second nut 25 that fastens the battery terminal T to the threaded shaft 1.

Figure 2:
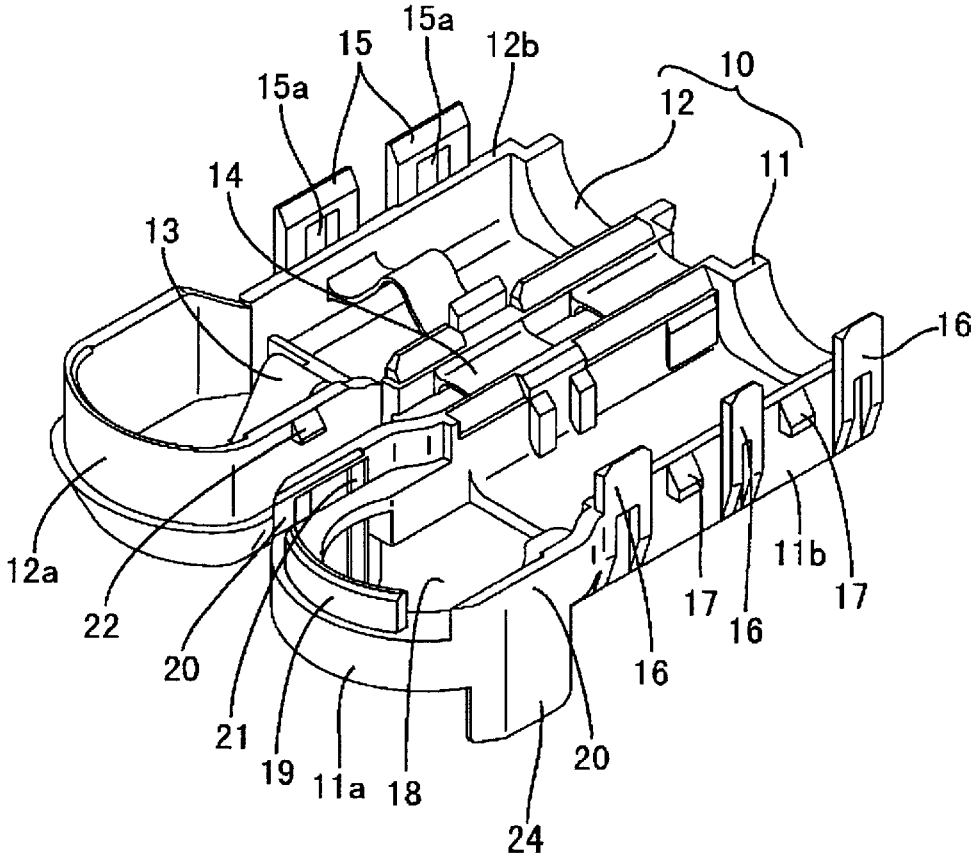
FIG. 2 is a perspective view of a terminal cap in its fully opened state.
Figure 3:
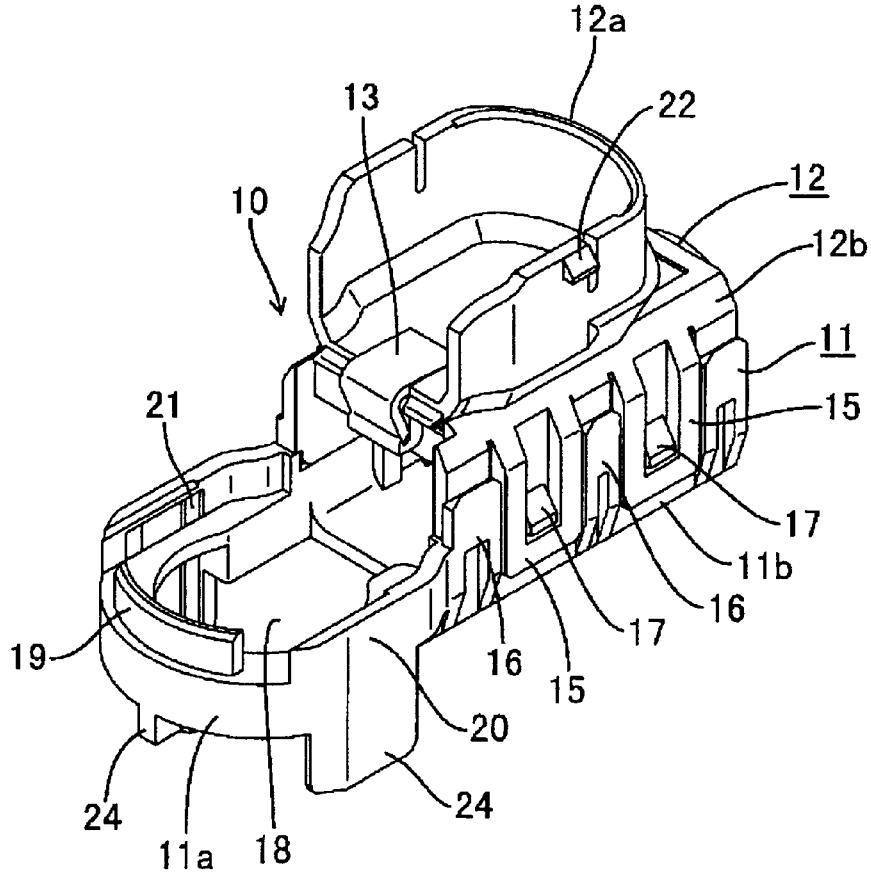
FIG. 3 is a perspective view showing an opened state of a second lid.

The terminal cap 10 initially is positioned in the fully opened condition shown in FIG. 2, and the battery terminal T that is to be connected with the (+)-electrode is mounted in the open terminal cap 10. The second lid 12*b* then is rotated about the hinges 14 and is guided into the closed position by the guides 16. Sufficient rotation enables the locking holes 15*a* of the locking arms 15 to engage the locking projections 17. As a result, the second lid 12*b* is held substantially closed.

With the first lid 12*a* left open, the threaded shaft 1 is inserted through the through hole 8 of the battery terminal T, and the locking projections 9 of the battery terminal T enter between the rotation preventing projections 5 of the rotation preventing member 4. The second nut 25 then is screwed onto the threaded shaft 1 to connect the battery terminal T with the threaded shaft 1. Finally, the first lid 12*a* is rotated sufficiently about the first hinge 13 to engage the corresponding locking projections 22 and locking recesses 21, and to hold the first lid 12*a* closed. In this way, connection of the battery terminal T is completed.

Figure 5:
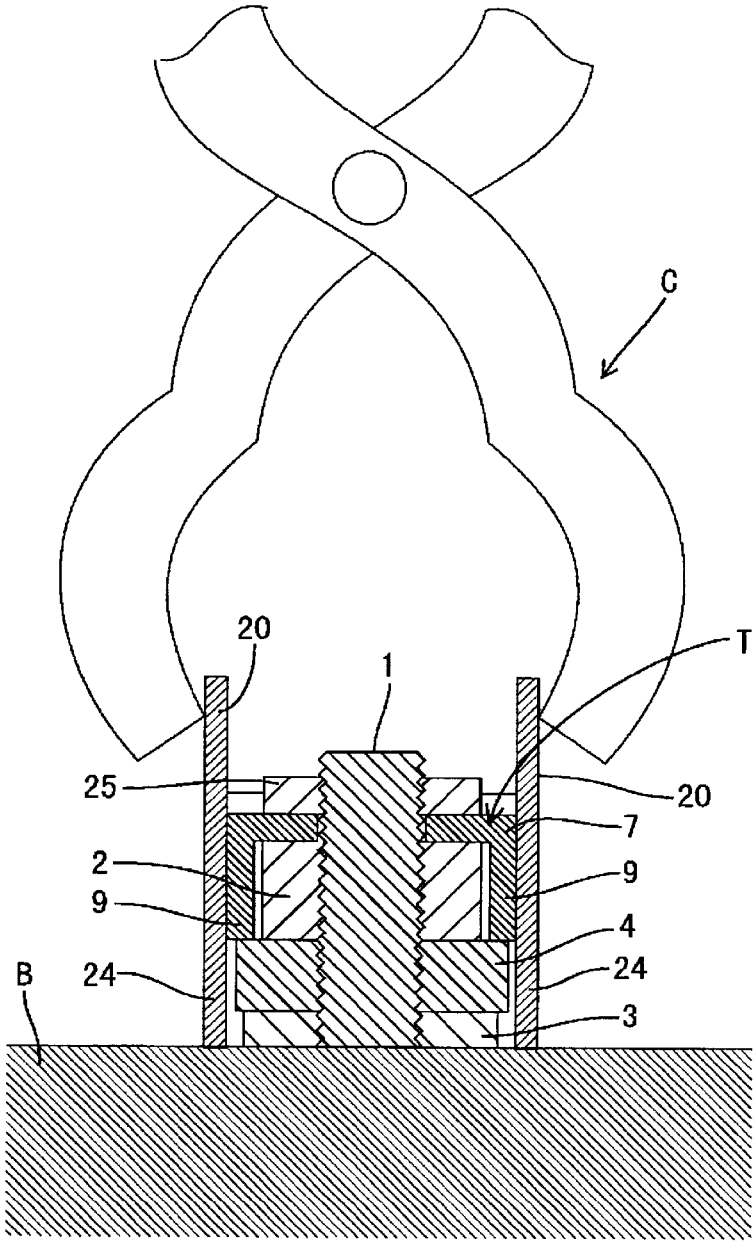
FIG. 5 is a section showing a connection impossible state of a booster cable.
Figure 6:
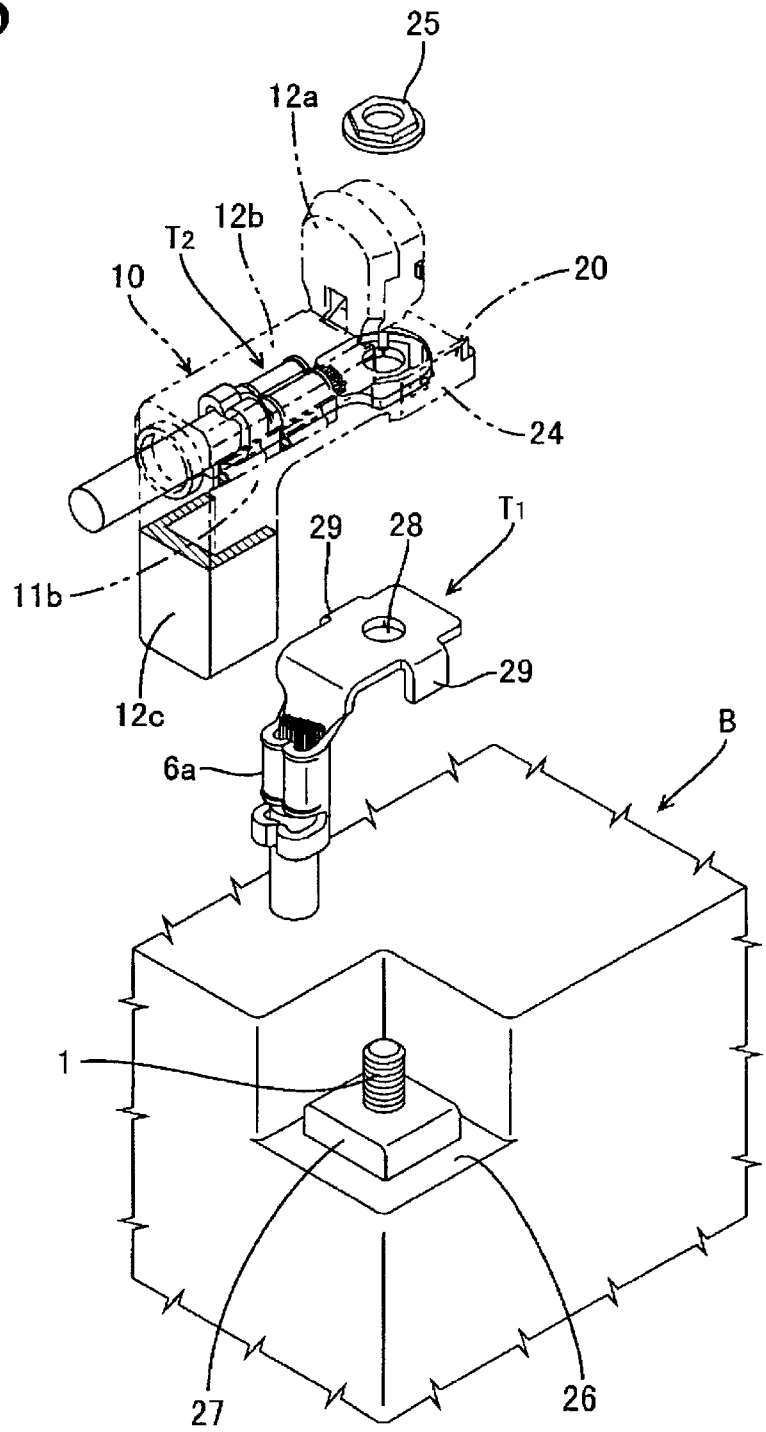
FIG. 6 is a perspective view of a second embodiment.
Figure 7:
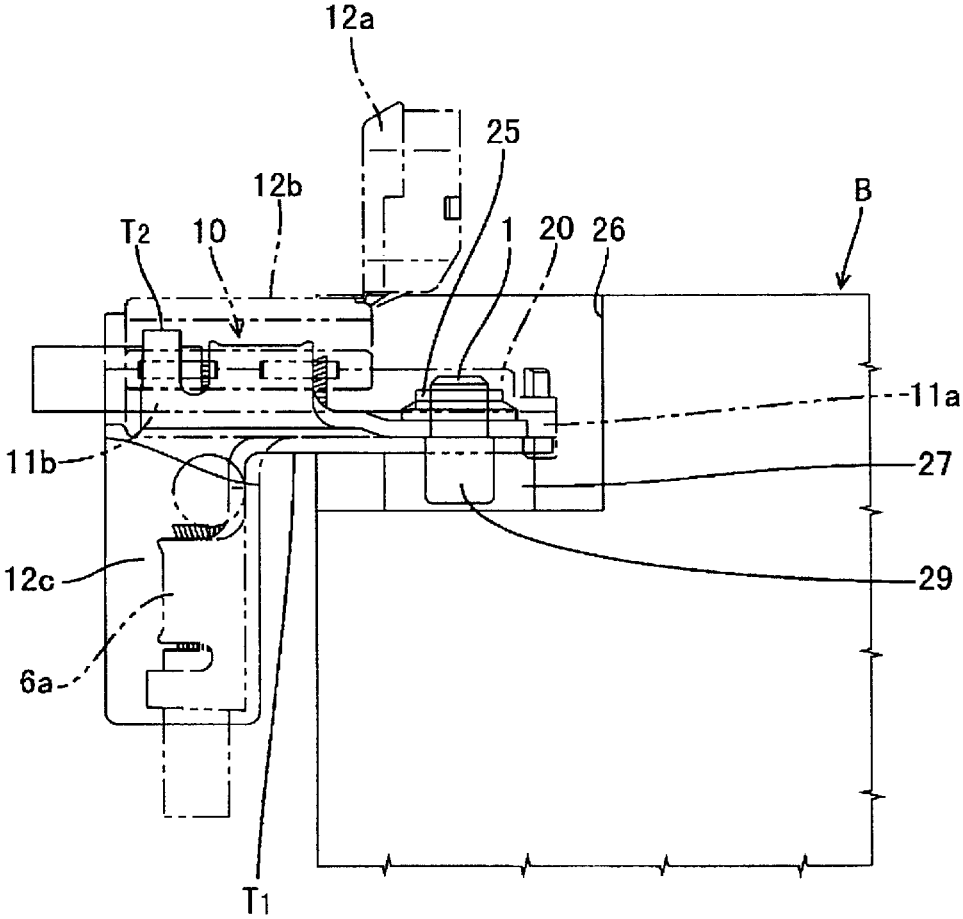
FIG. 7 is a side view of the second embodiment showing a state connected with a battery.

The battery B may die and may require connection with a battery B of another vehicle by a booster or connection cable. Thus, the locking projections 22 and the locking recesses 21 are forcibly disengaged from each other and the first lid 12*a* is opened. An attempt could be made to connect the battery B with a 12V-battery B using a booster cable intended for the connection of two 12V-batteries B. However, such a connection is prevented by the subject invention. In particular, the clip C of the booster cable normally is gripped to clamp the threaded shaft 1 or the second nut 25 while widening a spacing of the leading ends of the clip or clamp C. However, the upper ends of the upper protection walls 20 of the terminal cap 10 are higher than the upper end of the threaded shaft 1. Additionally, the width of the upper protection walls 20 is set such that the clip C will interfere with the upper protection walls 20, as shown in FIG. 5. Accordingly, the clip C cannot enter the first accommodating portion 11*a* and cannot clamp either the threaded shaft 1 or the second nut 25. Therefore, erroneous connection of batteries B having different specifications can be avoided. FIGS. 6 and 7 show an embodiment of the invention where battery terminals T1, T2 are connected one over the other on an electrode of a battery B. Specifically, the (+)-electrode of the battery B comprises a threaded shaft 1 that projects from a recess 26. A washer 27 is provided on the bottom surface of the recess 26 and surrounds the base of the threaded shaft 1. The lower battery terminal T1 is mounted to the threaded shaft 1 without being covered. More particularly, the lower battery terminal T1 includes a barrel 6*a* that is connected to a wire and a connecting portion 7*a* that is bent with respect to the barrel 6*a*. A round hole 28 is formed through the center of the connecting portion 7*a*, and the threaded shaft 1 is inserted through the round hole 28. Opposite sides of the connecting portion 7*a* are bent down to form a pair of holding pieces 29 that engage the washer 27 and prevent rotation of the battery terminals T1, T2.

A terminal cap 10 is mounted on the upper battery terminal T2. The terminal cap 10 is substantially the same as the terminal cap 10 of the first embodiment. However, a rear part of a second accommodating portion 11*b* extends down to form a bent portion 12*c* that extends along one side surface of the battery B. The bent portion 12*c* is closed on three sides, but is open on a side that faces the battery B so as to substantially cover the barrel portion 6*a* sideways.

The terminal cap 10 of FIGS. 6 and 7 has upper protection walls 20 that are dimensioned to project upwardly beyond the threaded shaft 1 when the battery terminals T1, T2 are connected with the threaded shaft 1. Additionally, the upper protection walls 20 are spaced apart by a distance that prevents a clip C of a booster cable from being connected with either the threaded shaft 1 or the second nut 25 while the clip C is open.

Other structural features of the second embodiment are the same as or similar to the first embodiment. Thus, no further description is given, but the similar parts are identified by the same reference numerals.

Various changes can be made in the present invention, and following embodiments are also embraced by the technical scope of the present invention as defined in the claims.

The terminal cap 10 is not necessarily applied only to the (+)-electrode, and may be applied to the (−)-electrode or both electrodes.

Although the terminal cap 10 is provided with the protection walls in the foregoing embodiments, the battery B itself may be provided with the protection walls.

What is claimed is:

1. A construction for preventing erroneous connection of first and second different batteries by a booster cable, the first battery having a surface and an electrode projecting a selected distance from the surface, the construction having a substantially tubular first wire accommodating portion having opposite first and second ends and a wire passage extending between the ends, a second wire accommodating portion extending substantially orthogonally from the first end of the first wire accommodating portion and communicating with the wire passage of the first wire accommodating portion, the second wire accommodating portion being a substantially U-shaped channel having a base wall substantially aligned with the first end of the first wire accommodating portion and opposed sidewalls extending from the base wall and extending from the first wire accommodating portion, a protecting portion at the second end of the first wire accommodating portion and configured for substantially surrounding the electrode, the protecting portion being dimensioned for projecting from the surface of the first battery a distance greater than the selected distance for interfering with a clip of the booster cable and preventing connection of the clip with the electrode.

2. The construction of claim 1, wherein the first wire accommodating portion comprises a base and a cover hingedly connected to one another, the second wire accommodating portion extending continuously from the base of the first wire accommodating portion.

3. The construction of claim 2, wherein the protecting portion comprises a base extending unitarily from the base of the first wire accommodating portion and a cover hingedly connected to the cover of the first wire accommodating portion.

4. The construction of claim 3, wherein the surface of the first battery is a top surface, the battery further comprising a side surface extending orthogonally from the top surface and spaced from the electrode by an offset distance, the second wire accommodating portion being spaced from the protecting portion of the construction by a distance selected for disposition of the second wire accommodating portion substantially adjacent the side surface of the battery when the protecting portion is disposed substantially surrounding the electrode.

5. The construction of claim 4, wherein the protecting portion is dimensioned for accommodating two battery terminals.

* * * * *